United States Patent [19]

Connelly

[11] Patent Number: 4,527,503

[45] Date of Patent: Jul. 9, 1985

[54] SPAR BUOY ESCAPE SYSTEM FOR OFFSHORE PLATFORMS

[75] Inventor: Ronald F. Connelly, Ventura, Calif.

[73] Assignee: Combustion Engineering, Inc., Windsor, Conn.

[21] Appl. No.: 665,095

[22] Filed: Oct. 29, 1984

Related U.S. Application Data

[63] Continuation of Ser. No. 473,823, Mar. 9, 1983, abandoned.

[51] Int. Cl.[3] ..... B63B 23/00

[52] U.S. Cl. ..... 114/365; 114/349; 114/264; 441/38; 441/87

[58] Field of Search ..... 182/48, 49; 114/264, 114/365, 322, 323, 328, 349, 256, 350; 440/34; 441/24, 25, 26, 27, 28, 38, 87

[56] References Cited

U.S. PATENT DOCUMENTS

| | | | |
|---|---|---|---|
| 348,158 | 8/1886 | Fischer | 114/349 |
| 849,887 | 4/1907 | Clark | 441/28 |
| 934,322 | 9/1909 | King | 441/87 |
| 1,042,894 | 10/1912 | Crull et al. | 441/87 |
| 1,160,257 | 11/1915 | Burns | 440/34 |
| 1,377,486 | 5/1921 | Johnson | 441/28 |
| 3,433,323 | 3/1969 | Ukawa | 182/48 |
| 3,708,991 | 1/1973 | Barkley | 114/264 |
| 3,796,281 | 3/1974 | Dowling | 182/48 |
| 3,921,558 | 11/1975 | Redshaw | 114/264 |

FOREIGN PATENT DOCUMENTS

| | | | |
|---|---|---|---|
| 2042608 | 9/1980 | United Kingdom | 114/264 |

*Primary Examiner*—Trygve M. Blix
*Assistant Examiner*—Thomas J. Brahan
*Attorney, Agent, or Firm*—Arthur L. Wade

[57] ABSTRACT

An offshore platform is shown in position over the seabed. An escape chamber in the form of a spar buoy is mounted on a platform and extends from the platform above the surface of the water to below the surface. A cable also extends between the buoy and an anchor located on the seabed remotely from the platform. When the buoy is released from its platform mount and cable winched from the buoy, the buoy is pulled over the anchor to float safely during adverse weather conditions.

3 Claims, 3 Drawing Figures

SPAR BUOY ESCAPE SYSTEM FOR OFFSHORE PLATFORMS

TECHNICAL FIELD

This application is a continuation of application Ser. No. 473,823, filed Mar. 9, 1983, now abandoned.

The present invention relates to a spar buoy form of escape chamber adapted to be pulled from its mounting on an offshore platform to a safe distance as a refuge from life-threatening weather conditions. More particularly, the invention relates to pulling a spar buoy, as an escape chamber, to a safe anchorage enabling the buoy to contain personnel below adverse conditions while communicating with life support systems at the surface.

BACKGROUND ART

Enough experience has now been accumulated to conclusively demonstrate the limitation of escape equipment provided for personnel working on offshore platforms. Much of the past and present safety provisions have been biased toward providing escape craft supported at the sea surface, such as boats. This "floating lifecraft" fixation has been discredited as providing inadequate protection for personnel abandoning doomed offshore platforms.

Superficially, it appears that sturdily constructed and well-provisioned surface lifecraft, entered efficiently and launched successfully, is an effective means of preserving life. However, the violent storms destroying these platforms have claimed the lives of enough personnel to thoroughly discredit these surface crafts as havens of refuge for personnel. Of course, if the personnel can be removed from the platform, well in advance of developing life-threatening weather conditions, the problem would be solved. Boats and aircraft, employed in time, are quite effective in preserving life. It is the illusion that platforms are effectively designed to withstand the fury of cyclonic storms that has lead to the entrapment of personnel by their decision to ride out the danger of the storms. In the face of platform collapse, it is now evident that few lifecraft at the surface of the sea have been preserving a significant percentage of the lives of the personnel. Obviously, something is dreadfully wrong with the superficial assumptions that have been made to date by personnel seeking safety at the sea surface.

With safety proven non-existent at the surface of the sea, it has been suggested that refuge be sought entirely below the surface. Serious consideration has been given to the concept of transporting personnel to a location entirely below the surface. It has appeared that a system can be provided to transport threatened personnel a significant distance below the surface of the disturbed sea to provide dramatic increase for their chances of survival. Seemingly, all that was required was a change in conventional attitude to accept a submersible vessel for transporting personnel to a safe sea depth. It now appears economically chimerical to provide a life-support system for a completely submersible escape vessel.

A logical combination of the concepts embodied in surface escape craft and the concepts embodied in a completely submersible lifecraft is possible. If a lifecraft form can be provided which places the majority of its bulk a significant distance below disturbed surface conditions while providing safe access to life support surface systems, the disadvantages of both prior systems can be eliminated.

DISCLOSURE OF THE INVENTION

The present invention contemplates providing an escape chamber or capsule accessible to the personnel of structurally threatened offshore platforms, the capsule being dismountable from the platform and drawn to a location remote from the platform and held in a floating position to provide a safe haven for personnel below the surface of the water while communicating with the air above the surface with minimum vulnerability to the wind and wave disturbance at the sea surface.

The invention further contemplates the escape chamber provided with internally operable means to winch the chamber to a safe location close to an anchor on the sea floor.

The invention further contemplates the escape chamber in the form of a spar buoy with ballast means to control the frequency of the buoy relative to that of the waves.

Other objects advantages and features of this invention will become apparent to one skilled in the art upon consideration of the written specification, appended claims, and attached drawings.

BRIEF DESIGNATION OF THE DRAWINGS

BEST MODE FOR CARRYING OUT THE INVENTION

Terms and Technology

In this disclosure, for consistency the term "sea" will be utilized. However, it is to be understood that any large body of water having a bottom at which drilling and production of an oil well is carried out will be included in this term. The sea may be an ocean, gulf, bay, etc., all of which have a bottom on which oil well drilling and production is carried out. In all events, the present depth is expected to be up to 3,000 feet. Whatever depth is available beneath the offshore platform, it is expected to be great enough to provide the basic security from wave action and weather turbulence which exist at the surface.

In this disclosure, the term "lifecraft" may be given many variations. Basically, the disclosure is of a compartment in which personnel have shelter from the hostile environment outside the compartment, with life-support facilities available to the compartment. "Compartment" may be termed a capsule, a submersible vehicle, a personnel chamber, etc.

The lifecraft is provided for shelter of personnel who work on an offshore platform. The offshore platform may be termed a drilling or production rig which, in turn, may be permanently erected upon pilings driven into the bottom or sea-bed and extending above the sea surface. On the other hand, the offshore platform may be a tethered float maintained in position over that point on the seabed being drilled or from which the flow lines of production extend.

As for the lifecraft itself, the drawings indicate the form of a "spar buoy". In the most general sense, the spar buoy is a vertically extended, or elongated, form which will float in its vertical orientation. It is generally accepted that the spar buoy will float with its upper part extended above the surface of the sea, while its lower portion extends down below the surface. Although there are many arrangements for tethering, or anchoring, the spar buoy at a location over the seabed, its weight distribution is arranged to urge the buoy to float vertically, partially submerged below the sea surface. It is this form for the floating escape chamber that gives basic cohesion to the embodiment of the present invention.

It is a concept of the present invention to provide an anchor on the seabed located remotely in a lateral direction from the platform. The anchor at this position is attached by a tether, or cable, to the spar buoy lifecraft mounted on the platform. This tether or cable length is controlled from within the lifecraft to pull the craft to above the anchor at the appropriate time.

The Sea, the Platform, and the Capsule

Figure 1:
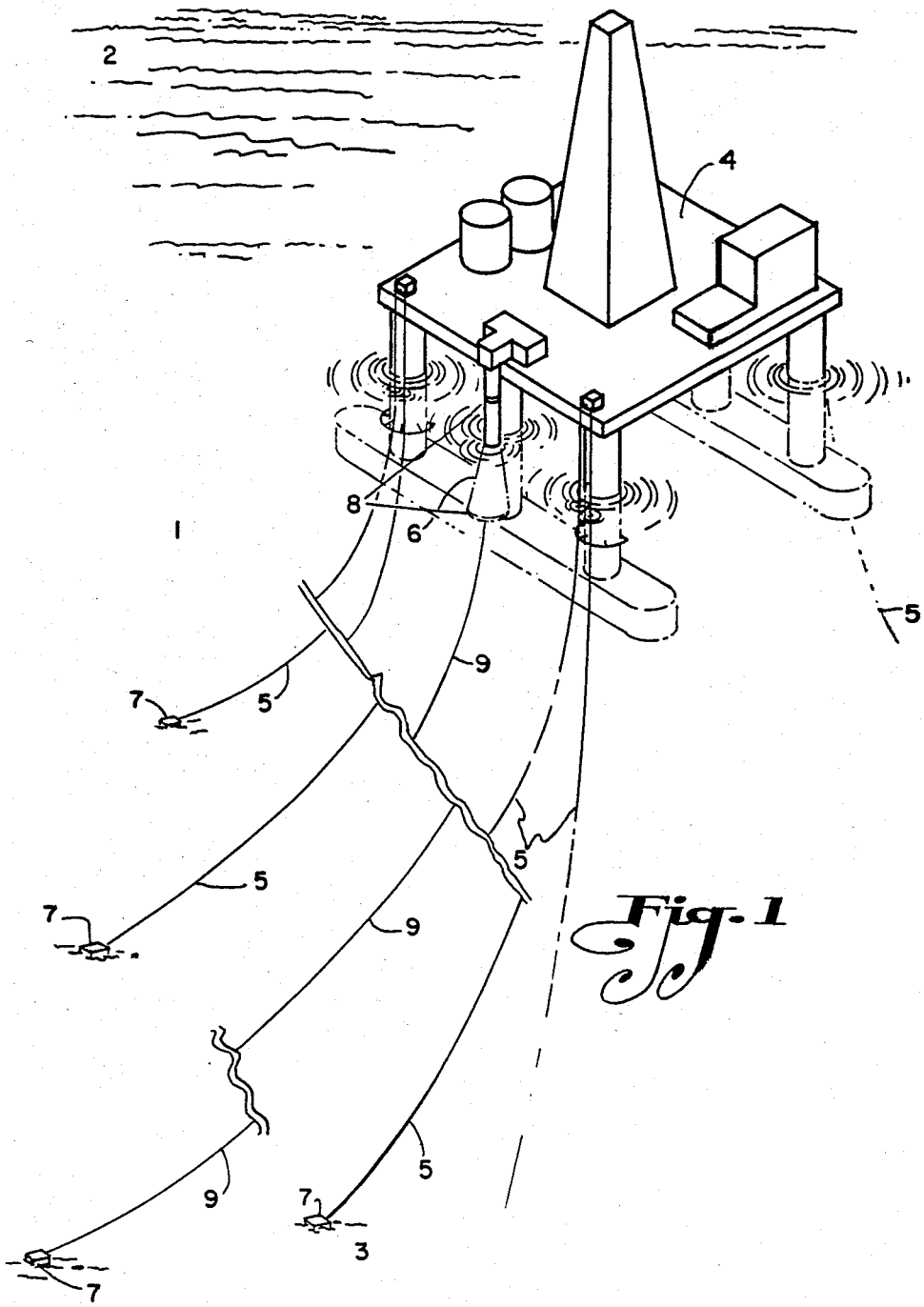
FIG. 1 is an isometric elevation of an offshore platform on which is mounted a lifesaving craft which embodies the present invention.

FIG. 1 gives a feel for the environment of the invention. The sea body 1 has a surface 2 and a floor, bottom, or bed, 3 which may be as far as 3,000 feet below surface 2. Presumably, the view is of that portion of the seabed into which an oil well has been drilled and from which production is being brought to surface 2. An offshore platform, or rig, 4 is floating above the oil well on the seabed. For the purposes of the present disclosure, the platform 4 is provided in the form of a semi-submersible structure having sufficient buoyancy to rear its upper end above the surface 2. Vertical orientation of the platform above the oil well is maintained by tethering the platform with cables 5 having anchors in the seabed far beyond the view of the installation disclosed in FIG. 1. Alternative to anchoring, thrusters may be mounted on the platform and provided with sophisticated control of their power to maintain the platform in position above the seabed.

The size, arrangement and function of the various structures making up the platform need not be described. It is sufficient to indicate that personnel normally swarm over the upper part of the structure to attend to their multiple duties and maintain their cycle of living over a period of weeks. It is the safety of this personnel with which the present invention is concerned.

To complete the picture, the lifecraft 6 is mounted on the platform 4 at a position and in an orientation in which it will be continuously available to serve the emergency needs of personnel on the platform. The elongated body of the lifecraft is extended with its upper end near the working surface of the platform, while its lower end is extended below the sea surface. There are many mounting details which need not be disclosed. These mounting arrangements, whatever their sepecific form, are required to hold the craft to the platform and readily release the craft when the time arrives to pull the craft away from the platform toward its remote location above the anchor 7. Inevitably, with the pitching and tossing of the platform structure in violent weather, the release of the craft from its mount will cause collisions between the craft and platform after the craft is freed. The craft will have to be designed to withstand these anticipated collisions and fenders 8 represent one form of structure provided for the craft which will mitigate the force of such collisions. It is not expected that the craft will be dismounted and drawn with alacrity toward its anchor 7 under calm conditions. Resort to the craft will only be when it becomes apparent that the life-threatening force of wind and waves reach the intensity requiring shelter within the craft. It is during these deteriorating environmental conditions that the craft will be cast off from its mounting on the platform and it is extremely doubtful that the personnel will be able to operate the apparatus at the speed to avoid collisions between the craft and platform once the craft has been removed from its mounting. Nevertheless, if the anchor 7 and the platform 4 are maintained in the general relationship disclosed in FIG. 1, prompt taking in of the cable 9 will be reasonably expected to draw the craft away from the platform, at least in the direction to minimize subsequent collisions.

At the Anchorage

The location of the platform above the subsea well, the lifecraft mounted on the side of the platform, and the location of the anchor 7 laterally remote from the platform position are all disclosed in FIG. 1. In contemplation of removal of the lifecraft from the vicinity of the platform to a floating position near the anchor 7 is disclosed in FIG. 2. This transition of the lifecraft is brought about by winching the cable 9 from one end. As the cable is taken in from the lifecraft 6, it is pulled away from the platform and toward its anchorage. The result is clearly illustrated in FIG. 2.

Figure 2:
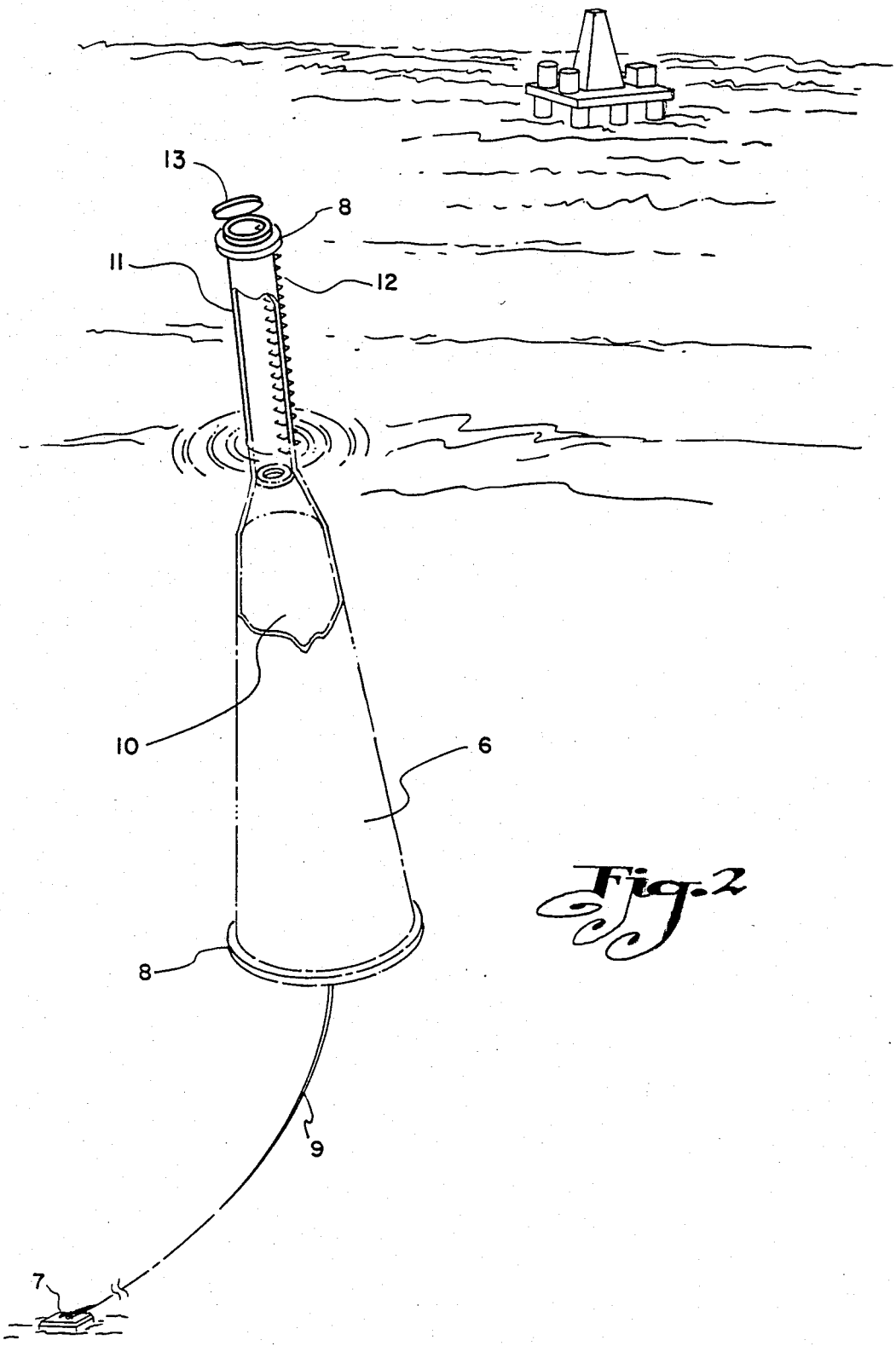
FIG. 2 is a perspective elevation of the lifecraft winched to its safe anchorage remote from the platform.

Further, FIG. 2 discloses in greater detail the overall form of the lifecraft 6 as conforming to a spar buoy whose upper end rides above the surface of the sea. More specifically, the lifecraft provides a compartment 10 well below the turmoil of surface conditions of the sea with a neck 11 as the extension terminating well above the surface of the sea. Despite the relative length of neck 11, a silohette of the spar buoy is reminiscent of the Erlenmeyer flask.

A ladder 12 is provided external of neck 11 so that personnel emerging from the top of neck 11 may descend to the surface of the sea, or personnel who find themselves in the sea may ascend to the hatch in the upper end of neck 11. Of course, a similar ladder is provided internally of the neck 11 for the ascent and descent of personnel to and from compartment 10. Hatch 13 is provided on the upper end of neck 11 in order to assure that temporary immersion of the neck will not provide an entry for water down into compartment 10. In contemplation of periodic immersion of neck 11, it is not unreasonable that a practical snorkel structure be included as a part of the hatch, or replacement of the hatch. The purpose of the snorkel, of course, would be to insure that air be pumped through neck 11 and down into compartment 10 whenever the end of neck 11 is free of the sea and riding above its surface.

It is apparent with the vertical orientation of the lifecraft, that pumping systems may be provided to draw life-supporting air from above the sea surface down into compartment 10. The provision of such life-support pumping mechanisms is far less expensive and complicated than that required for a submarine vessel.

Once the craft is on station, floating near its anchor 7, compartment 10 is tethered well below destructive wave action. The neck 11 is given the length which will extend it up through the turbulence near the surface of the sea. Due to the relatively small dimensions of neck 11, it will be subject to a minimum of wave action force while it serves as a conduit for air down to personnel safe within compartment 10. Therefore, the best features of surface craft are combined with the best features of submarine craft in the spar buoy. The destructive forces are minimized, while the safety of the personnel is maximized.

The Internals of the Spar Buoy

Figure 3:
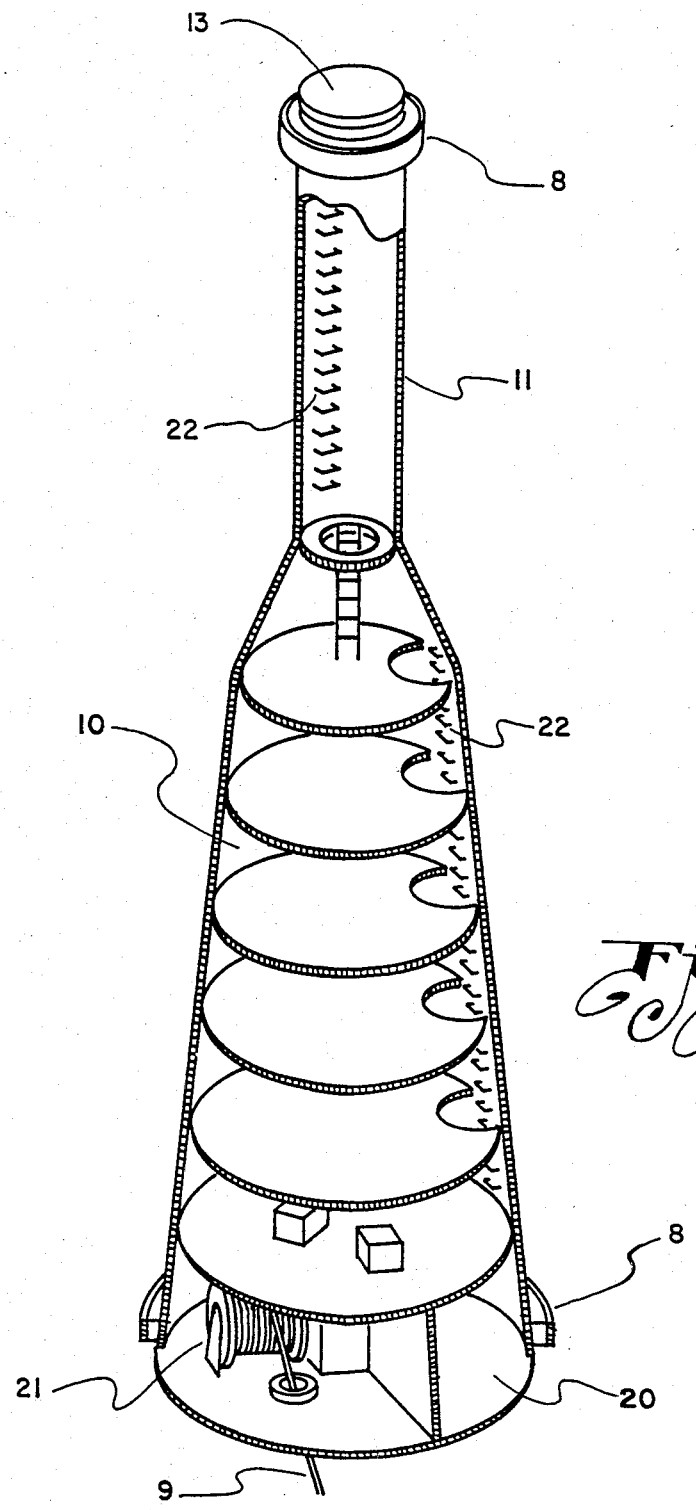
FIG. 3 is an isometric sectioned elevation of the lifecraft as it floats.

FIG. 3 provides a view of the ballast compartment 20 in the lower portion of compartment 10. A winch 21 is indicated as mounted in the lower portion of compartment 10 in order to take in and pay out the cable tether 9 from its one end, while it is secured to anchor 7 at the other end.

The living quarters are indicated within compartment 10 and access to these quarters is by way of ladder 22 extended up the inside of neck 11. No safer haven has yet been devised for personnel whose lives are threatened by climatic conditions surrounding an offshore platform.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

I claim:

1. A safety system for personnel occupying an offshore platform which protects and isolates the personnel from life-threatening weather and allows escape of personnel from the platform when the platform is unstable and no longer safe, including, an offshore platform supporting personnel above the surface while it extends below the surface of the sea, a floatable escape vessel in the form of a spar buoy having a relatively long hollow and relatively narrow tubular upper portion and a conical hollow lower portion with the narrowest part of the lower portion being located where it joins the upper portion and when the vessel is mounted on the platform the bottom of the upper portion and the top of the lower portion being approximately at sea level and when dismounted from the platform the vessel is ballast controllable such that the upper portion presents a small frontal area to the wind forces and a substantial amount of the entire vessel is below sea level to provide stability as a floating vessel and the top of the upper portion being openable and including means by which the personnel may enter the top portion from the platform and travel to the lower portion and the escape vessel being mounted on the platform at a location from which it will be dismounted into the sea after receiving the personnel, a compartment in the lower portion of the spar buoy, a winch mounted in the compartment, an anchor located on the seabed, and a tether connecting the anchor and the winch operated within the spar buoy to control the length of the tether between the anchor and the winch to permit the spar buoy to float at the surface of the sea above the anchor.

2. The safety system of claim 1, in which, the spar buoy is mounted vertically on the offshore platform to extend from above the surface of the sea to below the surface.

3. The safety system of claim 2, including, a water-tight hatch with which an opening in the upper portion of the spar buoy can be sealed temporarily to prevent entry of seawater.

* * * * *